United States Patent [19]

Marshall et al.

[11] 3,932,143

[45] Jan. 13, 1976

[54] FLAME-SPRAYED ROOFING MATERIAL

[75] Inventors: David W. Marshall, North Reading; William R. O'Day, Jr., Concord, both of Mass.

[73] Assignee: Kennecott Copper Corporation, New York, N.Y.

[22] Filed: May 23, 1974

[21] Appl. No.: 472,952

[52] U.S. Cl. ..... 29/195; 52/515; 427/423; 427/404

[51] Int. Cl.[2] ..... B32B 15/04

[58] Field of Search ..... 29/195 W, 195 Y, 199; 117/105.2; 52/556, 515, 516, 517

[56] References Cited

UNITED STATES PATENTS

| | | | |
|---|---|---|---|
| 1,839,535 | 1/1932 | Curran | 29/195 X |
| 1,862,332 | 6/1932 | Coffman | 29/195 X |
| 3,476,586 | 11/1969 | Valtchev et al. | 117/71 |
| 3,676,211 | 7/1972 | Kourtesis et al. | 117/212 |

*Primary Examiner*—L. Dewayne Rutledge
*Assistant Examiner*—E. L. Weise

[57] ABSTRACT

A building product, such as a roofing shingle or the like, is provided with flame resistance and protected against actinic degradation, and fouling by algae and micro-organisms by flame-spraying a metal coating on at least one side of the product and thereafter applying a second flame-sprayed coating, of copper, on the first layer to cover completely at least the one side of the product.

7 Claims, 2 Drawing Figures

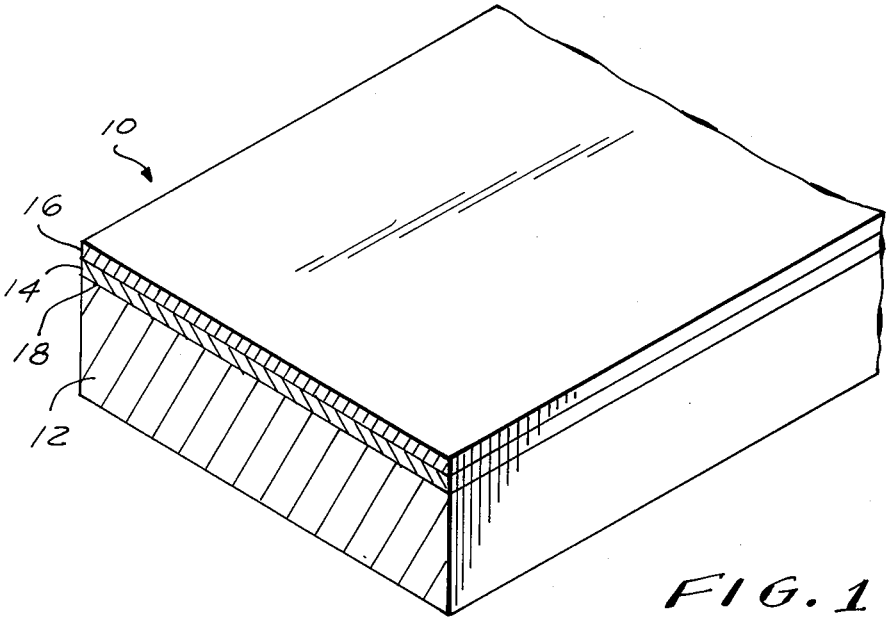
FIG. 1
FIG. 2
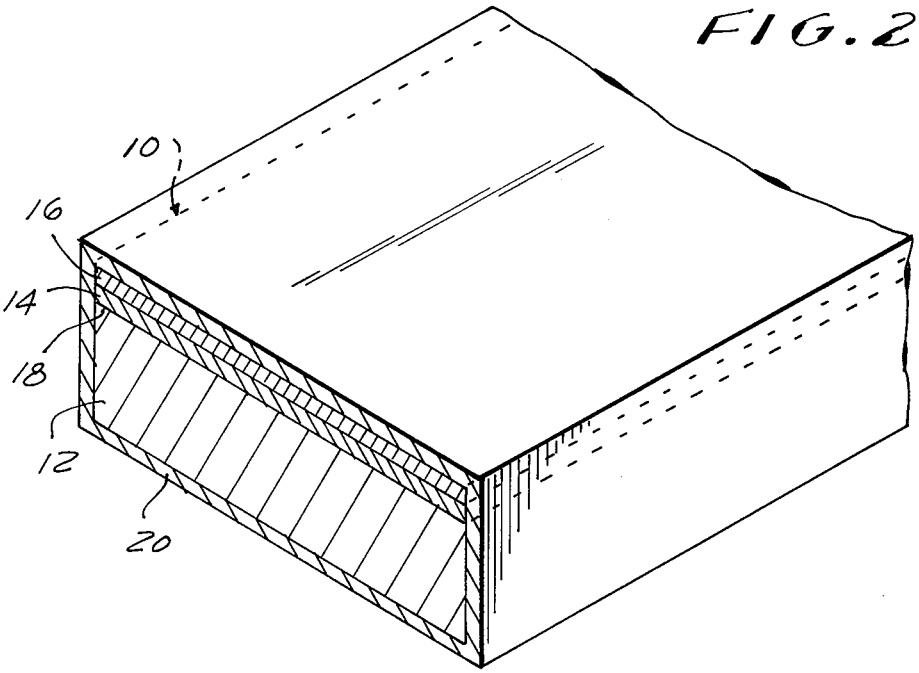

FLAME-SPRAYED ROOFING MATERIAL

The present invention relates to building products, and in particular to a building product such as roofing elements or wall boards, which are treated to improve their appearance, durability and flame retardant properties.

Various types of building elements presently used in the construction industry for forming the exterior walls and roofs of houses or other structures suffer from a number of serious disadvantages. In particular, most typical roofing materials such as asphalt or wood shingles are extremely flammable. Asphalt shingles are also subject to actinic degradation by untraviolet light from the sun. However, these materials are highly desirable for use in the building industry because these are relatively light in weight and inexpensive.

Other previously proposed building elements, particularly for use in roofing materials, such as concrete and clay tiles, while generally being fireproof, suffer from additional disadvantages particularly throughout the southern areas of this country. In southern climates, algae and other micro-organisms, quickly grow on and adhere to concrete or clay tiles. This requires that the concrete and clay tiles be cleaned periodically to remove the unsightly and possibly harmful algae. On the other hand, these products are desirable for use, again particularly in the southern climates, because they resist actinic degradation.

Accordingly, it is an object of the present invention to provide a building element which is formed of a desirable existing building material but which is treated to extend its life and make it flame resistant.

Yet another object of the present invention is to provide a building element formed of presently existing flammable materials, but made fire resistant and protected against actinic degradation.

Yet another object of the present invention is to provide a building element which is protected against unsightly algae and microorganism growth thereon.

A still further object of the present invention is to provide a method which will make flammable building material fire resistant while protecting them against actinic degradation, and which will also protect presently available building materials against attack by algae and the like.

In accordance with one aspect of the present invention a building element, such as a shingle or the like, is provided which can be formed of any conventional existing building material such as asphalt, clay or concrete tile, certain woods such as cedar, oak and maple, compressed mineral wool boards, or compressed vermiculite. The roofing element is flame-sprayed on at least one side thereof with a first coating of a metal such as aluminum, zinc or brass. Thereafter, the building element is treated with a second flame-sprayed coating, of copper, over the first metal coating, thereby to cover completely at least one side of the roofing element. A single coat of copper could be used. However, it has been found to be more economical to flame-spray first with aluminum, zinc or brass particularly on wood substrates where copper does not coat efficiently. The two metal coatings provide additional strength to the building element while rendering the same fire resistant. Where the element is formed of an asphaltic or plastic material, subject to actinic degradation, the metallic coatings on the element protect the same against such degradation. On the other hand, where the building element is formed of a clay or concrete material, which is subject to attack by algae, the metallic coatings on the element will mitigate the algae problem, avoiding of minimizing the necessity of periodically cleaning the clay or concrete building element.

The above, and other objects, features and advantages of the present invention will be apparent in the following detailed description of illustrative embodiments thereof, which description is to be read in connection with the accompanying drawings, wherein:

FIG. 1 is a partial perspective view of a roofing element constructed in accordance with one embodiment of the present invention; and FIG. 2 is a partial perspective view similar to FIG. 1 of another embodiment of the roofing element of the present invention.

Referring now to the drawing in detail, and initially to FIG. 1 thereof, it will be seen that a building element 10, constructed in accordance with the present invention, consists of a base element 12 having a pair of distinct coatings 14 and 16 applied thereto. Base element 12 can be formed of any existing building material which can be used to form exterior siding or roofing elements for houses and the like. A wood shingle is preferred. Thus, for example, element 12 can be a conventional roofing element or shingle formed of asphalt, compressed mineral wool, or compressed vermiculite, asbestos or wood. As mentioned, such materials are widely used in the building trades to form exterior siding and roofing elements. However, there are certain disadvantages with such materials in that some are highly flammable and certain of the materials are subject to actinic degradation under the effects of ultraviolet light from the sun so that their useful life is substantially shortened when used to form exterior building elements such as roofing shingles.

By the present invention it has been found that such materials can be made fire resistant and protected against actinic degradation by coating at least the exposed side thereof with a metallic layer or layers. This is conveniently done in accordance with the present invention by flame-spraying a metal coating, preferably of copper, onto the surface of the base element 12. Copper is preferred because it provides excellent resistance to algae growth and gives an appearance of a high quality product. The techniques of flame-spraying metals on a base element are well known. This process consists essentially of feeding a metallic wire through an oxygen-acetylene flame-spraying gun wherein the metallic wire is melted, atomized and sprayed onto the substrate being treated. Such spraying operations can be used to build up a coating or layer of varying thicknesses, from 1 mil up to at least 15 mils. The coating applied to the substrate by flame-spraying consists essentially of a layer of the metal itself, since the density of the sprayed metal is 85 to 95 percent of the solid metal. Thus, the flame-spraying of the wire is a convenient method of providing a solid metal layer on a substrate or base.

In accordance with the present invention it is contemplated that, in one embodiment, a single layer of copper of about one mil or more in thickness on one side of a roofing element, such as a wood shingle or an asphalt shingle, will satisfactorily protect the shingle against fire and actinic degradation. However, in the preferred embodiments of the invention, two coatings of metal are supplied to at least one side of the element 12 in order to introduce more efficient fire retardation and protect base element 12. Thus, for example, as seen in FIG. 1, two layers or coatings 14, 16 of separately flame-sprayed metal are applied to one side 18 of base 12. It has been found that satisfactory building elements formed in accordance with the present invention have the first or lowermost coating 14 on building element 12, formed of flame-sprayed aluminum, zinc, or brass. These metals are preferred for the lowermost layer 14 because they impede the degradation of copper and are lower in cost than copper. They also appear to coat temperature sensitive substrates such as wood and asphalt more efficiently than copper.

The outer or exterior layer 16 on the element 10, in the embodiment of FIG. 1, consists of a flame-sprayed coating of copper which also may have a thickness of approximately one mil or more. Copper is a highly desirable metal for the exterior coating on the building element since it is an architecturally accepted material. That is, it is a characteristic of copper that after being applied it changes to a characteristic and classical color which is desirable and accepted in a building industry. In addition, it has been found that where copper is coated over a previously flame-sprayed layer of zinc, the color changes to a highly attractive pinkish beige color.

Although the illustrative embodiment of the invention illustrates two metal coatings 14, 16 on base 12, it is contemplated that more than two such layers can be applied to the base 12 as required. Thus, for example, where the degree of fireproofing must be increased, the number of layers applied can be increased, or their thickness can be increased. In this connection, it is noted that the metal layers add additional strength to the base 12 and by increasing their number and thickness, the amount of increased strength or reinforcement provided by the metal layers can of course be also increased.

In any case, it will be seen that by flame-spraying the metal layers on the base 12, the base is protected against fire. Of course, the entire base can be flame-sprayed about its entire periphery, prior to application or use in a building construction, so that it is entirely covered by a fire retardant layer. It is also contemplated that the flame-spraying will be performed only on the exposed side of the base 12, after the building is completed. In addition, by the provision of the metal coatings on base 12, where the base is formed of asphalt, vermiculite, or other materials subjected to actinic degradation, it will be protected against the ultraviolet radiation from the sun so that the useful life of the base will be significantly extended.

In addition, as mentioned above, where base 12 is formed of a material which is subject to attack by algae or other micro-organisms, the metal coatings on the exterior surface will prevent formation and growth of algae or other micro-organisms on the relatively rough surface of the concrete and tile because of the natural inhibition which copper has for algae growth. This avoids the periodic cleaning now required with such building materials. In addition, it will further be appreciated that by the construction of the present invention the building element retains substantially the same dimensions and weight as it originally had, while having the additional desirable characteristics of fire and rot resistance. Moreover, the flame-spraying process which achieves these desirable results is relatively inexpensive.

In addition to simply spray coating all or one side of a base building element, it has been found that the roofing elements can be further treated to extend their useful life and appearance by treating or impregnating the builiding element, after the flame-spray coating process, with methyl benzotriazole (MBT), or by impregnating the element with MBT and thereafter coating the entire element with an acrylic lacquer 20, as shown in FIG. 2. The acrylic coating may also be restricted to covering the flame-sprayed surface only.

The MBT is applied from an alcohol or other solvent solution (½% MBT in methanol is sufficient) by either brush or spray. Once the alcohol has evaporated the element is protected by coating with any acrylic lacquer such as Krylon Clear Spray or Sears & Robuck's clear Acrylic Enamel. It is expected that any other clear weather-resistant coating could also be used in place of the acrylic.

The MBT, as is known to those skilled in the art, retards the oxidation of copper. Similar materials which would provide protection similar to methyl benzotriazole would be benzotriazole, mercaptobenzotriazole, benzothiazole, dithiotoluol, and thioresorcinol. Many other azo- and thiocompounds would undoubtably act similarly.

In tests of wooden shingles flame-sprayed with metal in accordance with the present invention, it has been found that shingles coated with both MBT and an acrylic lacquer, after having been flame-sprayed, either with copper alone, or with combinations of a copper top layer and an aluminum, or zinc under layer, have retained essentially their same appearance after six month exposure and have darkened only slightly after 12 months.

The preferred construction and metals used in accordance with the present invention are a combination of a zinc undercoating 14 and a copper overcoating 16, both applied by the flame-spraying method. It has been found that a shingle treated in this manner provides an outer coating which appears to be self-cleaning since there was no stain on specimen samples constructed in accordance with this embodiment which were exposed to the elements for over twelve months. Moreover, the unstained copper outer layer changed, as mentioned above, to an attractive pinkish beige color which will provide an attractive exterior surface for building structures.

Although illustrative embodiments of the present invention have been described herein with reference to the accompanying drawings, it is to be understood that the invention is not limited to those precise embodiments, and that various changes and modifications may be effected therein by one skilled in the art without departing from the scope or spirit of this invention.

What is claimed is:

1. A building product comprising a base formed of a material selected from the group consisting of wood, mineral wool, asphalt, concrete, clay, asbestos, vermiculite, and mixtures thereof; a first flame-sprayed metal coating on at least one side of said base, said first flame-sprayed metal coating selected from the group consisting of aluminum, zinc and brass, and the second flame-sprayed coating of copper applied to said first metal coating.

2. The building product as defined in claim 1 wherein said product is treated and impregnated with a material selected from the group consisting of methyl benzotriazole, benzotriazole, mercaptobenzotriazole, benzothiazole, dithiotoluol, and thioresorcinol.

3. The building product as defined in claim 2 wherein said product is coated with acrylic lacquer.

4. A roofing element comprising of roofing shingle, a first flame-sprayed metal coating on at least one side of said shingle with the metal of said first coating being selected from the group consisting of aluminum, zinc and brass, and a second flame-sprayed coating of copper applied to said first coating to completely cover said first coating.

5. The roofing element as defined in claim 4 wherein said shingle is formed of a material selected from the group consisting of wood, mineral wool, asphalt, concrete, clay, asbestos, and vermiculite.

6. The roofing element as defined in claim 5 wherein said shingle is treated and impregnated with a material selected from the group consisting of methyl benzotriazole, benzotriazole, mercaptobenzotriazole, benzothiazole, dithiotoluol, and thioresorcinol.

7. The roofing element as defined in claim 6 wherein said product is coated with acrylic lacquer.

* * * * *